US008924050B2

(12) United States Patent
Katsuta et al.

(10) Patent No.: US 8,924,050 B2
(45) Date of Patent: Dec. 30, 2014

(54) RAILWAY SIGNALLING SYSTEM AND ON-BOARD SIGNALLING SYSTEM

(75) Inventors: Keiichi Katsuta, Hitachi (JP); Yoichi Sugita, Ibaraki-ken (JP); Keiji Maekawa, Mito (JP); Naoki Shibata, Hitachi (JP); Kenji Imamoto, Hitachi (JP); Motonari Suzuki, Mito (JP)

(73) Assignee: Hitachi, Ltd., Tokyo (JP)

( * ) Notice: Subject to any disclaimer, the term of this patent is extended or adjusted under 35 U.S.C. 154(b) by 268 days.

(21) Appl. No.: 13/550,747

(22) Filed: Jul. 17, 2012

(65) Prior Publication Data

US 2013/0024054 A1 Jan. 24, 2013

(30) Foreign Application Priority Data

Jul. 22, 2011 (JP) ..... 2011-160484

(51) Int. Cl.
*G05D 1/00* (2006.01)
*B61L 27/00* (2006.01)

(52) U.S. Cl.
CPC ..... *B61L 27/0061* (2013.01); *B61L 2027/0044* (2013.01)
USPC ..... 701/19; 701/20; 701/24; 701/25; 701/540; 246/167 R; 246/186; 246/184; 246/123; 246/187 A; 104/287; 104/289

(58) Field of Classification Search
CPC ..... B61L 2027/0044; B61L 27/0061
USPC ..... 701/19
See application file for complete search history.

(56) References Cited

U.S. PATENT DOCUMENTS 5,507,457 A * 4/1996 Kull ..... 246/169 R
6,505,103 B1 * 1/2003 Howell et al. ..... 701/19
6,587,763 B2 * 7/2003 Ishikawa ..... 701/19
6,856,865 B2 * 2/2005 Hawthorne ..... 701/19
2008/0184336 A1 * 7/2008 Sarukkai et al. ..... 726/1

FOREIGN PATENT DOCUMENTS

| | | |
|---|---|---|
| JP | 2003-048543 | 2/2003 |
| JP | 2005-275233 | 10/2005 |
| JP | 2005-323445 | 11/2005 |
| JP | 2007-264879 | 10/2007 |
| JP | 2010-000956 | 1/2010 |

OTHER PUBLICATIONS

ERTMS/ETCS—Class 1, System Requirements Specification, Chapter 1, Introduction, SUBSET-026-1, Feb. 24, 2006, pp. 1-7, Issue. 2.3.0.

* cited by examiner

*Primary Examiner* — Redhwan K Mawari
(74) *Attorney, Agent, or Firm* — Antonelli, Terry, Stout & Kraus, LLP.

(57) ABSTRACT

In a railway signalling system which transmits a control order to an on-board signalling system by a trackside signalling system, the on-board signalling system being mounted on a train running on a line and the control order being compliant with a signalling system of the line, the present invention allows the train to run through into lines with different signalling systems using a single on-board signalling system. When the train enters a line with a different signalling system from a current line, the on-board signalling system installs a train control application program compliant with the signalling system of the entering line. Then, the on-board signalling system executes the train control application program, allowing the train to be controlled on the entering line according to a control order created by the trackside signalling system of the entering line.

10 Claims, 4 Drawing Sheets

RAILWAY SIGNALLING SYSTEM AND ON-BOARD SIGNALLING SYSTEM

The present application is based on and claims priority of Japanese patent application No. 2011-160484 filed on Jul. 22, 2011, the entire contents of which are hereby incorporated by reference.

BACKGROUND OF THE INVENTION

1. Field of the Invention

The present invention relates to a railway signalling system and on-board signalling system which control railway trains and the like.

2. Description of the Related Art

In relation to such railway signalling systems, ERTMS/ETCS which is an integrated train control system intended to enable interoperability among European countries proposes a system requirements specification as described in "ERTMS/ETCS System Requirements Specification, Chapter 1 Introduction, 24.02.2006." The system requirements specification stipulates, "Many different railway signalling systems have been developed so far, but they are incompatible with one another and do not allow interoperability. To reduce costs, it is desirable to introduce a standardized system."

The conventional railway signalling system is made up of a dedicated trackside signalling system and a dedicated on-board signalling system, and a train cannot run unless it carries a dedicated on-board signalling system compliant with the railway signalling system of the line on which the train is to run. With such a railway signalling system, when running through into a line with a different signalling system, it is necessary to a carry an on-board signalling system compliant with the signalling system of each line and switch, at a boundary between lines, to the on-board signalling system used on the next line. This incurs high costs.

In contrast, if a common specification such as ERTMS/ETCS described in "ERTMS/ETCS System Requirements Specification, Chapter 1 Introduction, 24.02.2006" can be established for signalling systems, by simply carrying an on-board signalling system compliant with the common signalling system specification, trains can run through into lines which have adopted a signalling system with the common specification. However, in adopting such a common specification, it is difficult to adjust requested specifications among railway operators in charge of individual lines, complicating the specification in order to meet the requests of the individual railway operators, and thereby resulting in higher costs than conventional dedicated on-board signalling systems. Besides, the trackside signalling system on each line needs to comply with the common specification, incurring high update costs.

Thus, an object of the present invention is to provide a railway signalling system which enables running through into lines with different signalling systems using a single on-board signalling system.

SUMMARY OF THE INVENTION

To solve the above problem, a railway signalling system according to the present invention has adopted the following technical measures.

Specifically, (1) A railway signalling system which transmits a control order to an on-board signalling system by a trackside signalling system, the on-board signalling system being mounted on a train running on a line and the control order being compliant with a signalling system of the line, wherein when the train enters a line with a different signalling system from a current line, the trackside signalling system transmits a train control application program compliant with the signalling system of the entering line to the on-board signalling system and makes the on-board signalling system execute the train control application program, thereby allowing the train to be controlled on the entering line according to a control order created by the trackside signalling system of the entering line.

(2) In the railway signalling system, the trackside signalling system transmits an order to the on-board signalling system in order to change the train control application program executed at the boundary with the line with the different signalling system.

(3) In the railway signalling system, the trackside signalling system transmits an order to start the train control application program compliant with the signalling system of the entering line ahead of a boundary with the line with the different signalling system, to enable control based on the train control application program compliant with the signalling system of the entering line upon passage through the boundary while disabling control based on the train control application program compliant with the signalling system of the exiting line, and subsequently to terminate the train control application program compliant with the signalling system of the exiting line to the on-board signalling system.

(4) In the railway signalling system, more than one train control application program are provided per signalling system to accommodate differences in performance of a computing machine of the on-board signalling system; and the trackside signalling system selects a train control application program which satisfies operating conditions of the computing machine from among the train control application programs, and transmits the selected train control application program to the on-board signalling system.

(5) In the railway signalling system, more than one train control application program are provided per signalling system to accommodate differences in configuration of peripheral components connected to the on-board signalling system via an interface; and the trackside signalling system selects a train control application program which satisfies operating conditions of the peripheral components from among the train control application programs, and transmits the selected train control application program to the on-board signalling system.

Also, an on-board signalling system according to the present invention has adopted the following technical measures.

(6) An on-board signalling system mounted on a train and adapted to receive a control order compliant with a signalling system of a line on which the train runs, from a trackside signalling system, wherein when the train runs through into a line with a different signalling system from a current line, a train control application program compliant with a signalling system of the entering line is installed and executed, allowing the train to be controlled on the entering line according to a control order created by the trackside signalling system of the entering line.

(7) In the on-board signalling system, the train control application program executed is changed at a boundary with the line with the different signalling system.

(8) In the on-board signalling system, the on-board signalling system starts the train control application program compliant with the signalling system of the entering line ahead of the boundary with the line with the different signalling system, enables control based on the train control application program compliant with the signalling system of the entering line upon passage through the boundary while disabling control based on the train control application program compliant with the signalling system of the exiting line, and subsequently terminates the train control application program compliant with the signalling system of the exiting line.

(9) In the on-board signalling system, the on-board signalling system informs a peripheral component connected to the on-board signalling system via an interface about the type of the train control application program currently being executed.

(10) The on-board signalling system further comprises a computing machine; and an interface adapted to interconnect the peripheral component and the computing machine, wherein for each line on which the train runs, the computing machine installs and executes the train control application program compliant with the signalling system of the line.

(11) In the on-board signalling system, the on-board signalling system selects a train control application program which satisfies operating conditions from among more than one train control application program provided to accommodate differences in performance of a computing machine of the on-board signalling system, and executes the selected train control application program.

(12) In the on-board signalling system, the on-board signalling system selects a train control application program which satisfies operating conditions from among more than one train control application program provided to accommodate differences in configuration of peripheral components connected to the on-board signalling system via an interface, and executes the selected train control application program.

According to the present invention, when the train enters a line with a different signalling system from the current line, the on-board signalling system mounted on the train installs and executes the train control application program compatible with the signalling system of the entering line, making it possible to smoothly enter lines with different signalling systems using the single on-board signalling system without the need for separate on-board signalling systems compatible with respective signalling systems.

DETAILED DESCRIPTION OF THE PREFERRED EMBODIMENTS

Embodiments of the present invention will be described below with reference to the drawings.

Embodiments

First Embodiment

In the present embodiment, description will be given of an example of a railway signalling system which allows a train to run through into lines with different signalling systems using a single on-board signalling system.

Figure 1:
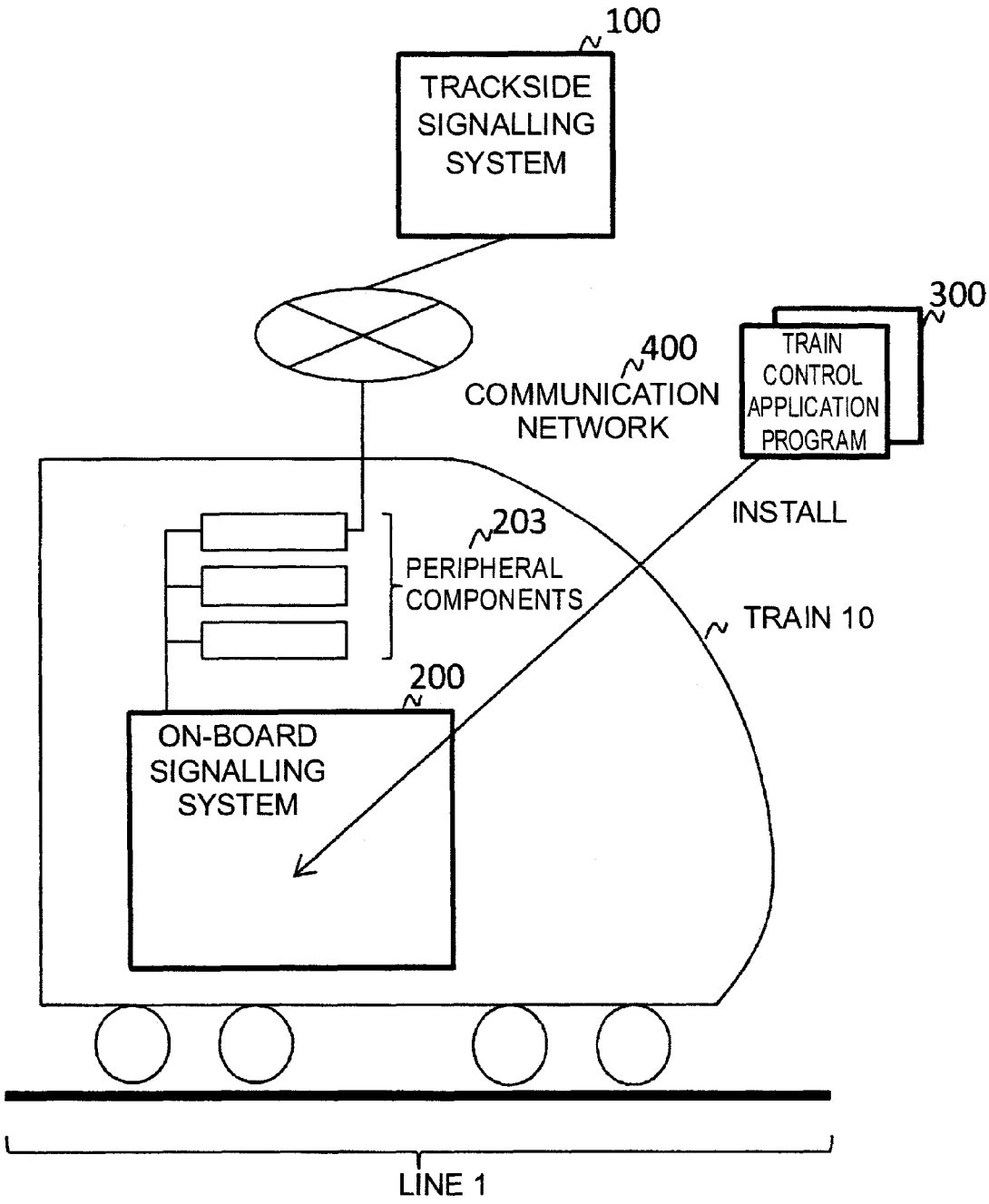
FIG. 1 is an exemplary configuration diagram of a railway signalling system according to the present invention.

FIG. 1 is an exemplary configuration diagram of a railway signalling system used in the present embodiment.

The railway signalling system includes a trackside signalling system 100, an on-board signalling system 200 mounted on a train 10, and train control application programs 300 executed by the on-board signalling system 200. The trackside signalling system 100 and on-board signalling system 200 are interconnected via a communication network 400 and peripheral components 203.

To control trains running on a line 1, the trackside signalling system 100 creates control orders for the on-board signalling system 200 mounted on each train, in compliance with the signalling system used on the line 1.

The on-board signalling system 200 executes the train control application program 300 compatible with the signalling system of the line 1 and controls the train 10 according to the control orders transmitted from the trackside signalling system 100.

Figure 2:
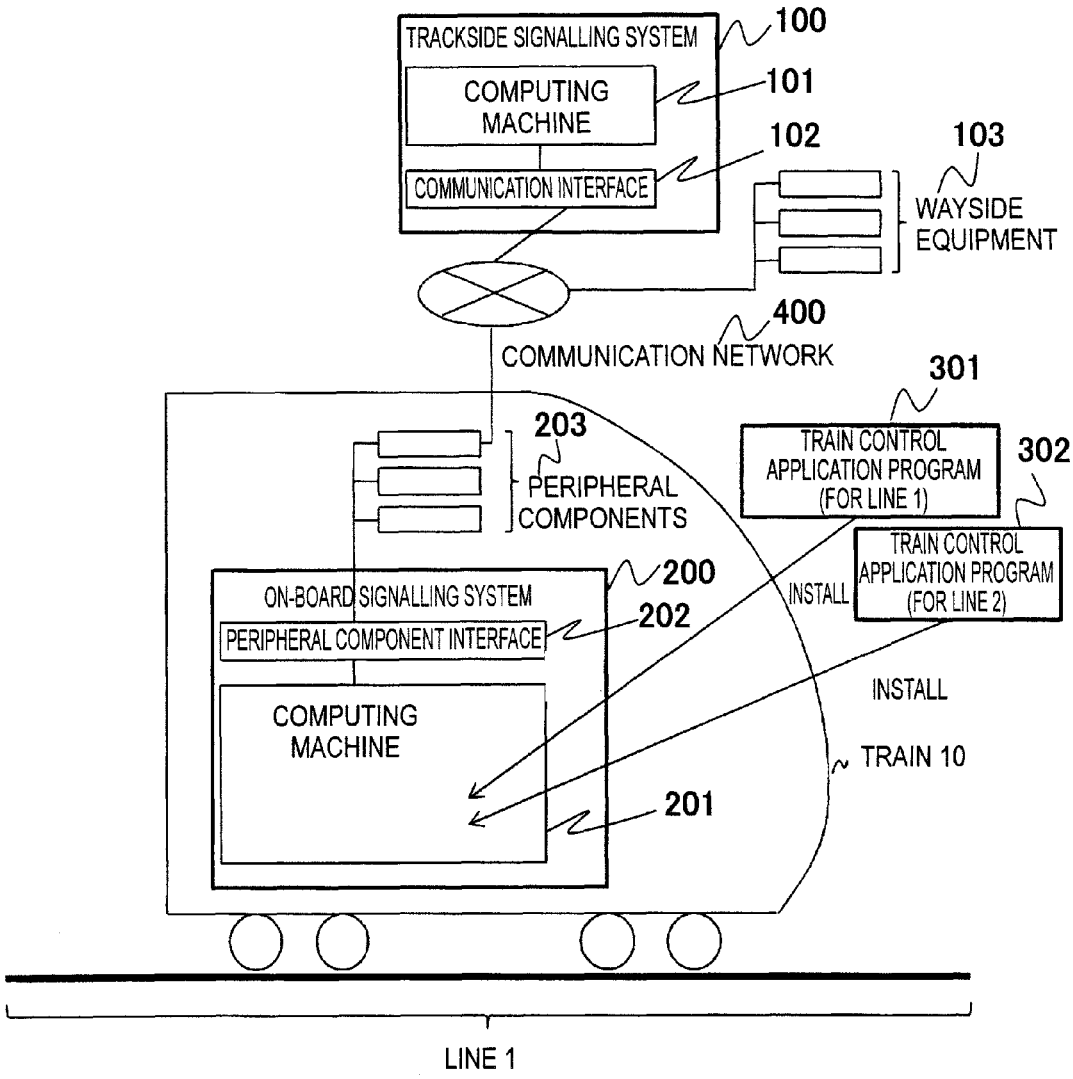
FIG. 2 is an exemplary detailed configuration diagram of the railway signalling system according to the present invention.

Next, a concrete configuration example of the railway signalling system according to the present invention will be described in detail with reference to FIG. 2.

In the railway signalling system according to the present embodiment, the trackside signalling system 100 includes a computing machine 101 and a communication interface 102 while the on-board signalling system 200 includes a computing machine 201 and a peripheral component interface 202. Regarding the train control application programs 300, it is assumed that a train control application program 301 is compliant with the signalling system of the line 1 while a train control application program 302 is compliant with a signalling system of a line 2.

The communication interface 102 of the trackside signalling system 100 is an apparatus adapted to connect the computing machine 101 to the communication network 400. The computing machine 101 communicates with the on-board signalling system 200 via the communication interface 102 and communication network 400.

The communication network 400 may be a public network, private network, or private communication channel. Also, plural communication networks or any communication system may be used. For example, conceivable communication systems include a space wave radio communication using 802.11, CDMA, or GSM and a near-field radio communication using a transponder, LUX, or a track circuit.

Furthermore, the computing machine 101 communicates with wayside equipment 103 via the communication interface 102 and communication network 400. Any communication system may be used. Also, the communication network used may be the same as or different from the one used for the communication with the on-board signalling systems. The wayside equipment is involved in operation of the trains on the line. The wayside equipment includes, for example, a train control system, CTC (centralized train control system), interlocking system, track circuit, switch machine, loop coil, and transponder.

To control the train safely according to the line-specific signalling system based on driving orders and train location information or train detection information inputted via the communication interface 102, the computing machine 101 creates control orders concerning moving authority and limit speed and transmits the control orders to the peripheral component interface 202 of the on-board signalling system 200 via the communication interface 102 and the communication network 400 and further via the peripheral components 203 (described later) on the train 10.

The peripheral components 203 are involved in control of the train. Examples of the peripheral components 203 include a communications apparatus and antenna used to communicate with the trackside signalling system by connecting to the wayside equipment and communication network 400, speed sensors and acceleration sensors adapted to measure speed and acceleration of the train 10, a display and switches used to exchange information with the train driver, a braking device adapted to operate brakes of the train 10, a TMS (Train Management System), and a data reader/writer. Any communication system may be used. For example, available communication systems include RS-485, Ethernet (registered trademark), PCI, MVB, CAN, and DI/DO (digital input/digital output). The peripheral component interface 202 of the on-board signalling system 200 is adapted to connect the computing machine 201 with the peripheral components 203.

From multiple train control application programs compliant with the respective signalling systems of the lines on which the train runs, the computing machine 201 installs and executes the train control application program according to the current signalling system, and creates control orders directed at the peripheral components to control the train 10, based on control orders from the trackside signalling system 100, sensor information from the peripheral components 203, and input information from the train driver, which are inputted via the peripheral component interface 202. The created control orders for peripheral components are transmitted to the respective peripheral components 203 via the peripheral component interface 202.

The control orders for peripheral components include not only orders directly relevant to control of the train 10, but also settings information for the peripheral components 203 and display information for the train driver. Examples of the display information for the train driver include current speed, limit speed, and driver assistance information as well as information needed to transmit the type and control mode of the currently executing train control application program.

The train control application programs 301 and 302 executed by the computing machine 201 are intended to create control orders for the peripheral components in order to control the train 10 according to the signalling systems of the line 1 and line 2, respectively. Device drivers used to operate the peripheral components 203 may be preinstalled on the computing machine 201 and switched at the same timing of switching between the train control application programs or may be included in the train control application programs.

The means of installing the train control application program may be of any form. For example, an appropriate train control application program may be installed by being downloaded from a wayside-located device such as the trackside signalling system 100 via a communication network or the train control application programs may be prestored on a recording medium such as a CD, DVD, or USB memory and an appropriate train control application program may be installed via the peripheral component interface 202 when program switching becomes necessary. In this way, if the computing machine 201 is provided with a means of installing a train control application program compatible with a given line as required, even if the on-board signalling system is not remodeled, the train can freely run through into a line on which the train has not been planned to run, a line whose signalling system has been updated without prior notice, or a line into which a new signalling system has been introduced without prior notice.

Figure 3:
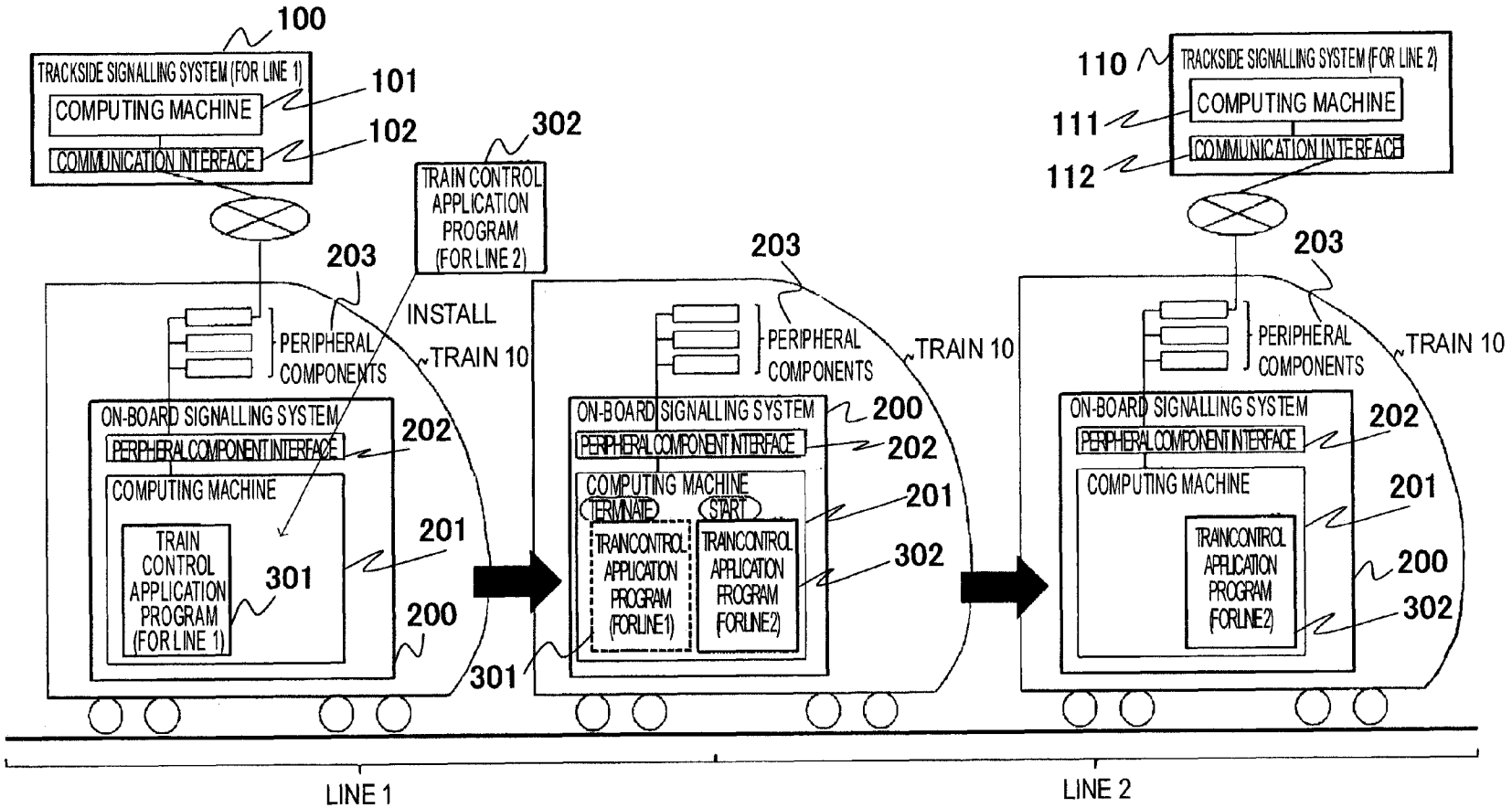
FIG. 3 is an example showing train program switching done when a train carrying an on-board signalling system according to the present invention runs through into a line with a different signalling system.

Next, with reference to FIG. 3, concrete description will be given of how the railway signalling system according to the present invention selects the train control application program when the train runs through into lines with different signalling systems using a single on-board signalling system.

As described above, the trackside signalling system 100 includes the computing machine 101 and communication interface 102 and creates control orders for the train running on the line 1. Also, the trackside signalling system 110 includes the computing machine 111 and a communication interface 112 and creates control orders for the train running on the line 2.

On the other hand, the on-board signalling system 200 is mounted on the train 10 and equipped with the computing machine 201 and peripheral component interface 202. While the train 10 is running on the line 1, using the train control application program 301 installed on the computing machine 201, the on-board signalling system 200 creates control orders directed at the peripheral components to control the train 10, based on the control orders created by the trackside signalling system 100.

Just before the train 10 runs through into the line 2 from the line 1, the trackside signalling system 100 or wayside equipment 103 informs the on-board signalling system 200 of line boundary position between line 1 and line 2 and gives an order to change the train control application program executed at the boundary position.

At about the same time, the trackside signalling system 100 installs the train control application program 302 compatible with the signalling system of the line 2 on the computing machine 201 of the on-board signalling system 200. The train control application program 302 is configured to create control orders directed at the peripheral components to control the train 10, based on the control orders created by the trackside signalling system 110 installed on the line 2.

Once the train control application program 302 is installed, the computing machine 201 of the on-board signalling system 200 terminates the train control application program 301 and starts and executes the train control application program 302 at the boundary between line 1 and line 2, and subsequently controls the train 10 according to the control orders created by the trackside signalling system 110.

If the border of the railway signalling systems is located, for example, on a track in a station yard near a national border, the train control application program can be switched while the train 10 remains stopped at the station.

However, when the border of signalling systems is located on a track between stations, since the train 10 could be running at high speed, the computing machine 201 of the on-board signalling system 200 may start the train control application program 302 before passage through the line boundary by allowing for the time required to start and terminate train control application programs, enable control by the train control application program 302 upon passage through the boundary while disabling control by the train control application program 301, and subsequently terminate the train control application program 301. This makes it possible to enter the line 2 without stopping the train.

Furthermore, after the train control application program 301 is terminated, the train control application program 301 may be erased. In that case, in the computing machine 201, a storage area used so far by the train control application program 301 is freed. A train control application program compliant with another signalling system can be installed anew in the freed storage area. That is, unless the train control application program compliant with the signalling system of a given line does not require a storage area in excess of storage capacity of the computing machine 201, the on-board signalling system 200 can run the train on an unlimited number of lines with different signalling systems, by repeating installation and erasure of train control application programs.

In this way, the railway signalling system according to the present invention allows the train to run on lines with different signalling systems using a single on-board signalling system, making it easy for the train to run through into other lines.

Second Embodiment

In the present embodiment, description will be given of an example of a railway signalling system which, by providing more than one train control application program per signalling system, allows every train to run on a given line using a single on-board signalling system even if different types of on-board signalling systems are mounted on the trains which run through into the line, for example, even if there are variations in the performance of the computing machine of on-board signalling systems or in the type of peripheral component configuration of trains.

According to the present embodiment, to accommodate types and characteristics differing of trains running on a given line, i.e., to accommodate differences in the performance of the computing machine of the on-board signalling system and configuration of peripheral components mounted on the trains, more than one train control application program are provided, the train control application programs being configured to create control orders directed at peripheral components to control a train, based on control orders created by a trackside signalling system. For example, each train control application program performs processes such as changing the cycle of processing the control orders received from the trackside signalling system according to processing speed of the computing machine mounted on the on-board signalling system of each train, changing the communication cycle with a communication network according to communication speed of a connected communications apparatus, changing display contents including speed according to display size, changing the method for calculating speed according to the accuracy of speed sensors, and changing the method for giving a brake command according to the type of braking device.

Figure 4:
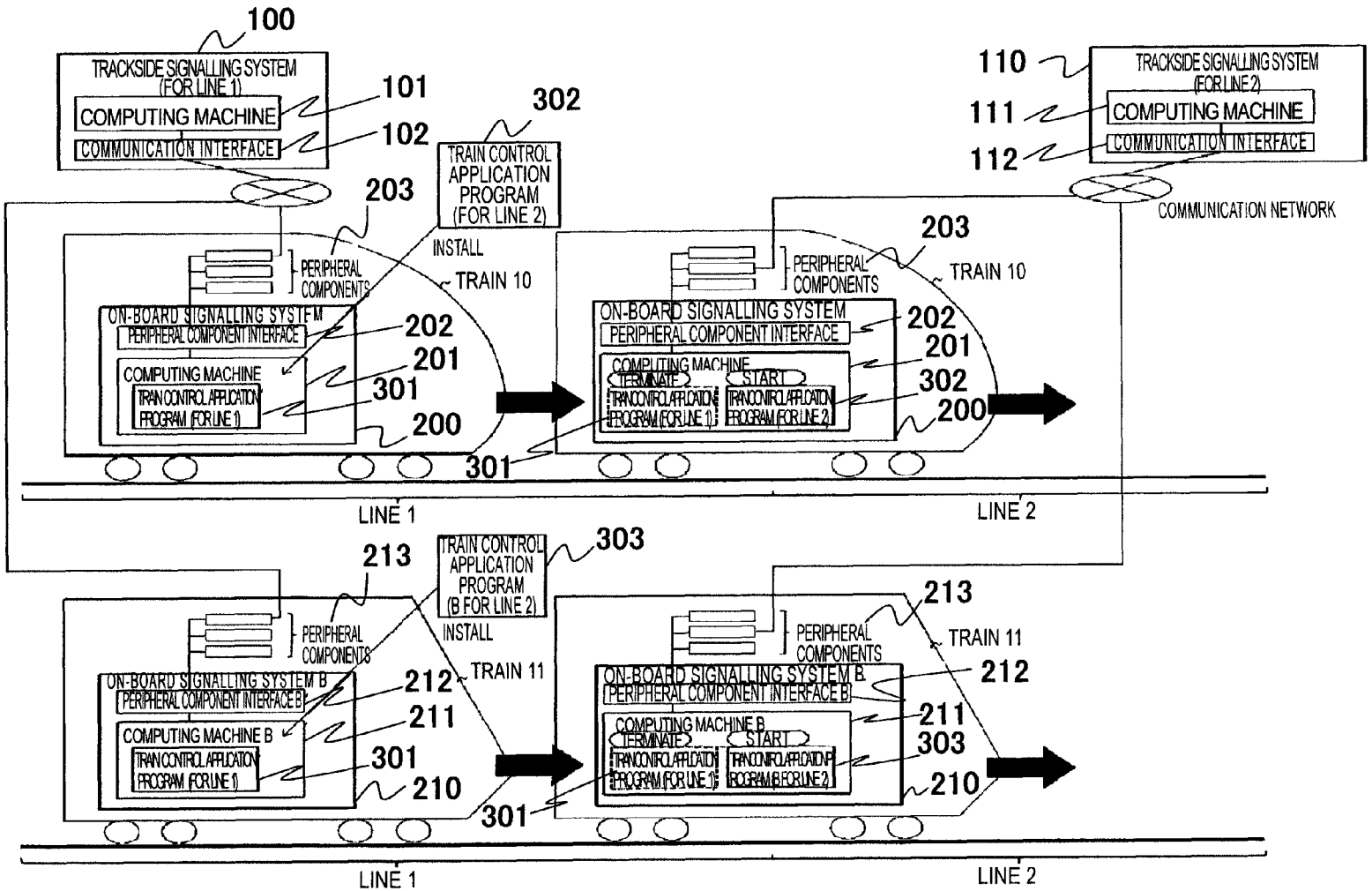
FIG. 4 is an example showing each train mounting different type of on-board signalling system to selectively start different train control application program compliant with the same signalling system.

With reference to FIG. 4, description will be given of an arrangement whereby the railway signalling system according to the present embodiment provides more than one train control application program and thereby allows each train to run on lines with different signalling systems using the on-board signalling system mounted on the train, even if there are variations in the performance of the computing machines of the on-board signalling systems and configuration of peripheral components mounted on the trains which run through into the line.

It is assumed that the trackside signalling system 100 includes the computing machine 101 and communication interface 102 and creates control orders for the train running on the line 1. Also, it is assumed that the trackside signalling system 110 includes the computing machine 111 and a communication interface 112 and creates control orders for the train running on the line 2.

It is assumed that the on-board signalling system 200 on the train 10 is equipped with the computing machine 201 and peripheral component interface 202. Also, it is assumed that by executing the installed train control application program 301 on the line 1, the computing machine 201 creates control orders directed at the peripheral components to control the train 10, based on the control orders created by the trackside signalling system 100.

On the other hand, it is assumed that the on-board signalling system 210 on the train 11 is equipped with the computing machine 211 and peripheral component interface 212. Also, it is assumed that by executing the installed train control application program 301 on the line 1, the computing machine 211 creates control orders directed at the peripheral components to control the train 11, based on the control orders created by the trackside signalling system 100.

As described in the first embodiment, when the train 10 runs through into the line 2 from the line 1, the train control application program 302 compliant with the signalling system of the line 2 is installed on the computing machine 201 of the on-board signalling system 200, the computing machine 201 executes the train control application program 302 when the train enters the line 2. Subsequently the train runs on the line 2, with the computing machine 201 controlling the peripheral components 203 according to the control orders created by the trackside signalling system 110.

Similarly, when the train 11 runs through into the line 2 from the line 1, the train control application program compliant with the signalling system of the line 2 is installed on the computing machine 211 of the on-board signalling system 210 and the computing machine 211 executes the train control application program compliant with the signalling system of the line when the train enters the line 2. Subsequently the train runs on the line 2, with the computing machine 211 controlling the peripheral components 213. However, let us assume that the on-board signalling system 210 with its type and characteristic does not satisfy operating conditions of the train control application program 302 for the train 10. Such is the case, for example, when the computing machine 211 is slower in processing speed than the computing machine 201 of the on-board signalling system 200, when a connected communications apparatus has a low communication speed, when speed sensor has a low accuracy, or when the display is small.

Possible methods for determining whether the operating conditions of the train control application program are satisfied are, for example, as follows: two tables can be prepared in advance, one describing operating conditions of respective train control application programs and the other describing specifications such as performance of computing machines and configuration of peripheral components on respective on-board signalling systems, and then a crew member can make a determination by comparing the two tables before installation; the on-board signalling system can transmit specification information such as described above to the trackside signalling system in advance and the trackside signalling system can select an appropriate train control application program based on the specification information and transmit the program to the on-board signalling system; the on-board signalling system of the train can prestore the types of train control application program which will satisfy the operating conditions of the computing machine on board and the on-board signalling system can check the type of train control application program which will satisfy the operating conditions, before installation; and the train control application programs can be provided in advance with a table describing the types of on-board signalling system which will satisfy the operating conditions and the on-board signalling system can check the table before installation.

If it is found consequently that the on-board signalling system 210 does not satisfy the operating conditions of the train control application program 302, another train control application program 303 which satisfies the operating conditions is installed on the computing machine 211 of the on-board signalling system 210. It is assumed that the train control application program 303 is able to operate with the given processing speed of the computing machine of the on-board signalling system 210, communication speed of the connected communications apparatus, accuracy of the speed sensor, and display size. The means of installation may be of any form as in the case of the first embodiment.

Desirably the train control application program 303 is configured to set, for example, the permissible speed of the train to a low level by taking into consideration the performance of computing machines and configuration of peripheral components and control the peripheral components 213 by allowing for rather long margins of brake reaction distance and brake stopping distance so as to ensure the same level of safety as the train control application program 302 without compromising the safety of the entire line 2.

Once the train control application program 303 thus configured is installed, the computing machine 211 of the on-board signalling system 210 executes the train control application program 303 when the train enters the line 2. Subsequently the train runs on the line 2, with the computing machine 211 controlling the peripheral components 213 according to the control orders created by the trackside signalling system 110.

In this way, by providing more than one train control application program per signalling system, the railway signalling system according to the present invention allows every train to run on a given line using a single on-board signalling system, making it easy for the train to run through into another line even if various types of on-board signalling systems are mounted on the trains which run through into the line.

It should be noted that the present invention is not limited to the embodiments described above and may include a wide variety of variations. For example, the above embodiments have been described in detail to clearly illustrate the present invention, and it is not strictly necessary to include all the components described above. Also, the railway signalling system according to the present invention may be configured to include all or part of the communication network, wayside equipment, and peripheral components.

As described above, according to the present invention, when the train enters a line with a different signalling system from the current line, the on-board signalling system mounted on the train installs and executes the train control application program compatible with the signalling system of the entering line, around a boundary between the two lines, making it possible to smoothly run through into lines with different signalling systems using the single on-board signalling system without the need for separate on-board signalling systems compatible with respective signalling systems. Thus, the present invention is expected to be widely adopted especially to trains which run across national borders.

What is claimed is:

1. A railway signalling system which transmits a control order to an on-board signalling system by a trackside signalling system, the on-board signalling system being mounted on a train running on a line and the control order being compliant with a signalling system of the line, wherein when the train transitions to a different line with a different signalling system from a current line, the trackside signalling system transmits both an order to the on-board signalling system in order to change the train control application program executed at a boundary with the different line with the different signaling system, and a train control application program compliant with the signalling system of the different line, to the on-board signalling system, and makes the on-board signalling system execute the train control application program, thereby allowing the train to be controlled on the different line according to a control order created by the trackside signalling system of the different line.

2. A railway signalling system which transmits a control order to an on-board signalling system by a trackside signalling system, the on-board signalling system being mounted on a train running on a line and the control order being compliant with a signalling system of the line, wherein when the train transitions to a different line with a different signalling system from a current line, the trackside signalling system transmits both a train control application program compliant with the signalling system of the different line and an order to start the train control application program compliant with the signalling system of the different line ahead of a boundary with the line with the different signalling system, to enable control based on the train control application program compliant with the signalling system of the different line upon passage through the boundary while disabling control based on the train control application program compliant with the signalling system of an exiting said current line, and subsequently to terminate the train control application program compliant with the signalling system of the exiting said current line to the on-board signalling system, and makes the on-board signalling system execute the train control application program compliant with the different line, thereby allowing the train to be controlled on the different line according to a control order created by the trackside signalling system of the different line.

3. The railway signalling system according to claim 1, wherein more than one train control application program are provided per signalling system to accommodate differences in performance of a computing machine of the on-board signalling system; and the trackside signalling system selects a train control application program which satisfies operating conditions of the computing machine from among the train control application programs, and transmits the selected train control application program to the on-board signalling system.

4. The railway signalling system according to claim 1, wherein more than one train control application program are provided per signalling system to accommodate differences in configuration of peripheral components connected to the on-board signalling system via an interface; and the trackside signalling system selects a train control application program which satisfies operating conditions of the peripheral components from among the train control application programs, and transmits the selected train control application program to the on-board signalling system.

5. An on-board signalling system mounted on a train and adapted to receive a control order compliant with a signalling system of a line on which the train runs, from a trackside signalling system, wherein when the train transitions to a different line with a different signalling system from a current line, both an order to change the train control application program executed at a boundary with the different line with the different signalling system sent from the trackside signalling system is received, and a train control application program compliant with a signalling system of the different line is received from the trackside signalling system, installed, and executed, allowing the train to be controlled on the different line according to a control order created by the trackside signalling system of the different line.

6. An on-board signalling system mounted on a train and adapted to receive a control order compliant with a signalling system of a line on which the train runs, from a trackside signalling system, wherein when the train transitions to a different line with a different signalling system from a current line, a train control application program compliant with a signalling system of the different line is received from the trackside signalling system, installed, and executed, allowing the train to be controlled on the different line according to a control order created by the trackside signalling system of the different line, wherein the on-board signalling system starts the train control application program compliant with the signalling system of the different line ahead of the boundary with the line with the different signalling system, enables control based on the train control application program compliant with the signalling system of the different line upon passage through the boundary while disabling control based on the train control application program compliant with the signalling system of an exiting said current line, and subsequently terminates the train control application program compliant with the signalling system of the exiting said current line.

7. The on-board signalling system according to claim 5, wherein the on-board signalling system informs a peripheral component connected to the on-board signalling system via an interface about the type of the train control application program currently being executed.

8. The on-board signalling system according to claim 5, further comprising: a computing machine; and an interface adapted to interconnect a peripheral component and the computing machine, wherein for each line on which the train runs, the computing machine installs and executes the train control application program compliant with the signalling system of the each line.

9. The on-board signalling system according to claim 5, wherein the on-board signalling system selects a train control application program which satisfies operating conditions from among more than one train control application program provided to accommodate differences in performance of a computing machine of the on-board signalling system, and executes the selected train control application program.

10. The on-board signalling system according to claim 5, wherein the on-board signalling system selects a train control application program which satisfies operating conditions from among more than one train control application program provided to accommodate differences in configuration of peripheral components connected to the on-board signalling system via an interface, and executes the selected train control application program.

* * * * *